US008353230B2

(12) United States Patent
Cole

(10) Patent No.: US 8,353,230 B2
(45) Date of Patent: Jan. 15, 2013

(54) WRENCH WITH WRENCH HEAD HAVING A PLANAR OVERHANG

(76) Inventor: Charles Austin Cole, Wylie, TX (US)

( * ) Notice: Subject to any disclaimer, the term of this patent is extended or adjusted under 35 U.S.C. 154(b) by 331 days.

(21) Appl. No.: 12/798,476

(22) Filed: Apr. 5, 2010

(65) Prior Publication Data

US 2011/0239831 A1 Oct. 6, 2011

(51) Int. Cl.
*B25B 13/00* (2006.01)

(52) U.S. Cl. ..... 81/125.1; 81/125

(58) Field of Classification Search ..... 81/180.1, 81/125, 119, 121.1, 176.1, 176.15, 185.2, 81/186, 418, 419, 124.3, 124.7, 125.1
See application file for complete search history.

(56) References Cited

U.S. PATENT DOCUMENTS 1,550,436 A * 8/1925 Hall ..... 81/119
1,936,352 A * 11/1933 Dixon ..... 81/125.1
2,697,371 A * 12/1954 Bowman ..... 81/125.1
2,715,347 A * 8/1955 Johnson ..... 81/124.2
3,121,356 A * 2/1964 Davis ..... 81/125.1
3,324,748 A * 6/1967 Williams ..... 81/124.3
4,084,456 A * 4/1978 Pasbrig ..... 81/177.8
4,787,273 A * 11/1988 Griffith ..... 81/13
5,307,713 A * 5/1994 White ..... 81/180.1
7,013,762 B2 * 3/2006 Hsien ..... 81/124.3

* cited by examiner

*Primary Examiner* — Robert Pezzuto
(74) *Attorney, Agent, or Firm* — Michael Diaz

(57) ABSTRACT

A wrench head having a jaw with jaw members having interior side faces and throat support surfaces defining an interior for mateably receiving a nut or bolt head. Extending from the top side of each jaw member and the top side of a handle connection portion and overhanging the interior defined by the interior side faces of the jaw members and throat support surfaces is a wrench head overhang, that, when placed over a nut or bolt head, is in contact with the top side of the bolt head or top side of the nut. The wrench head overhang serves to retain the wrench head over the nut or bolt head so that the wrench head cannot slip down off of the nut or bolt head. The overhang is dimensioned so as to that when the wrench of the present invention is used to rotate a nut that has been threaded on a bolt shaft, the bolt shaft will clear the sides of the overhang.

16 Claims, 4 Drawing Sheets

WRENCH WITH WRENCH HEAD HAVING A PLANAR OVERHANG

CROSS REFERENCE TO RELATED APPLICATIONS

Not Applicable.

TECHNICAL FIELD

The present invention relates to hand tools and particularly to hand tools for turning threaded fasteners, such as bolts, nuts and the like, and more particularly to open-end wrench heads being fixed to a handle, or coupled with a ratcheting or indexable coupling mechanism, to a handle or shank.

BACKGROUND OF THE INVENTION

For purposes hereof, the term bolt is generically used to refer to any of a bolt, through bolt, cap screw, machine screw, set screw or stud. A bolt typically has a cylindrical shaft portion and a head portion, referred to as a bolt head. Often the shaft of the bolt is threaded to receive a nut having a corresponding threaded aperture. The bolt head has a planar top, which is in the plane orthogonal to the central axis of the shaft and the bolt head also has an opposing bottom where the bolt head joins the shaft, and a plurality of planar side faces orthogonal to the bolt head, the planar side faces joining the top and the bottom of the head. The planar side faces are a plurality of substantially flat sides of approximately the same dimension defining an across side dimension and intersecting at a plurality of corners. The planar top and bottom of the bolt head are often hexagonally shaped and sometimes square shaped. American National Standard bolts and nuts come in inch and metric sizes. The number of planar side faces of the bolt head correspond to the number of edges of the top and bottom of the head, where an edge corresponds to a continuous linear portion thereof. For example, a square head has four (4) side faces and a hexagonal head has six (6) side faces. The nut has a top and bottom and orthogonal side faces corresponding to the edges of the top and bottom and an aperture through the central axis thereof, such aperture typically being threaded. The planar side faces of the nut are a plurality of substantially flat sides of approximately the same dimension defining an across side dimension and intersecting at a plurality of corners.

In order to impart rotational motion to nuts, bolts, via the bolt heads, and similar fasteners, a tool is placed to contact the plurality of planar side faces of the nut or bolt head, as the case may be. Conventional open-end wrenches are often used to impart such rotational motion using torque by applying force against a lever arm. Such open-ended wrenches typically have a wrench head. The wrench head of the conventional open-ended wrench is comprised of a jaw having a first jaw member, an opposite facing second jaw member and a throat. In this manner, the two jaw members of the open-ended wrench head can be placed in contact with two, opposite facing faces of the bolt head or nut, with the bolt or nut being received generally in the throat of the wrench head. Closed or box-end wrenches also have a wrench end, but with a closed end enclosing the throat and jaw members.

Disadvantageously, nuts, bolt heads and similar fasteners are often located in areas with very limited accessibility. Unlike ratcheted tools, conventional open-end that are fixed to a handle have limited freedom of rotational movement. To deal with this, often the opening of an open-end wrench is offset at angle relative to the handle. The offset is fixed at anywhere from 15 to 60 degrees. However, this does not solve the obstacle problem, but only allows the user to engage the fastener head at a different approach angle with the hope of extending its rotational movement by avoiding obstacles. Further, both open-end and closed-end wrenches have the disadvantage that once the plane of the jaw orthogonal to the opposing faces of the jaw members is placed in the same plane relative to the top and bottom of the nut or bolt head, as the case may be, there is no mechanism that keeps the wrench head in that plane. As a result, the jaw of the open-end and closed-end wrench head can easily slip up or down, thus losing contact with the side faces of the nut or bolt.

A socket wrench, more commonly referred to as a ratchet, is a type of wrench, or tightening tool that uses separate, removable sockets to fit many different sizes of fittings and fasteners, most commonly nuts and bolts. The socket wrench includes a ratcheting mechanism that allows the nut to be tightened or loosened with a reciprocating motion, without requiring that the wrench be removed and refitted after each turn. Typically, a small lever behind the socket switches the wrench between tightening and loosening mode. The sockets are attached to the ratchet through a square fitting that contains a spring loaded ball detent mechanism to keep the sockets in place. These drive fittings come in four common sizes: ¼ inch, ⅜ inch, ½ inch, and ¾ inch (referred to as "drives", as in "⅜ drive"). Despite being denominated in inches, these are international standards and no metric counterparts exist. Larger drive sizes i.e. ¾ inch, 1 inch and above are usually reserved for use on fasteners used on larger industrial equipment, e.g. in shipyards. The sockets themselves come in a full range of inch (SAE) and metric sizes. Users are advised that the two should not be substituted for each other, even if the fit seems "close"—as it may destroy the nut or bolt head. The sole exception is the ¾" and 19 mm sockets, which vary by only one twentieth of one millimeter (less than the width of a human hair).

Extensions, sometimes called "extender arms", allow access to nuts that are difficult to reach, typically in automotive applications. A breaker bar is an extended-length tool handle for socket wrenches that adds extra torque for loosening strongly tightened or frozen fasteners. Universal joints are two articulated socket joints combined at a right angle that allow a bend in the turning axis of the wrench. They are used with extensions for turning a bolt or nut at a difficult to access location. Flex tool handles are socket wrenches in which the drive head pivots back and forth on the tool handle, to allow the tool handle to avoid obstructions when being turned in a cramped space. Adapters allow sockets of one drive size to be used with wrenches of another drive size. They consist of a male drive fitting of one size attached to a female drive fitting of another size. For example, a ¼ in. to ⅜ in. adapter allows sockets with ¼ in. drive holes to attach to ⅜ in. wrenches.

To overcome the disadvantages of the open-ended wrench, a user may use a ratchet and socket assembly which allows the socket to maintain constant contact with the nut or bolt head while enabling the ratchet body to return to the starting point. However, the use of a ratchet and socket assembly is extremely limited because it is generally cumbersome and large, due to the internal mechanical components of the ratcheting mechanism. As such, the ratchet often cannot be used because it is too large to fit over a fastener's head due to the limited clearance relative to an obstacle.

SUMMARY OF THE INVENTION

The present invention is a variation on the open-end wrench. There are two embodiments of the wrench head of the present invention, each having a number of species related to the coupling mechanism coupling the wrench head to a tool handle or shaft, and the nature of the tool handle or shaft. The tool handle has a distal end and proximate end with the wrench head at the proximate end.

In the first embodiment of the tool of the present invention, the wrench head has a handle connection portion that couples to a tool handle or shaft at a first end and a jaw at the opposite, second end. The handle connection portion can be any desired three dimensional shape such as a cylindrical, cubic or the like and integrally fixed to a tool handle or shaft or having a aperture therein to receive a coupling mechanism component. The jaw extends from the handle connection portion and is then bifurcated into a first jaw member and a second jaw member with an angled throat in the interior portion of the jaw that includes where the first jaw member and second jaw member meet.

Each jaw member has a plurality of faces, the faces being at least a top face and exterior side face, bottom face and interior side face and end face. If the jaw member is oriented in a three-dimensional grid with x-y-z axes, then the top face and bottom face would be in the plane of the x-z axes and the exterior, interior and end faces would have components extending into the x-y-z planes. The interior side faces of the first and second jaw members are the nut or bolt head driving surfaces and are generally parallel, but they may slightly converge outwardly at a small angle of approximately 1-5 degrees to improve the flat engaging contact with the opposite sides of the nut or bolt head.

The throat includes a two flat planar support surfaces angled with respect to each other and angled with respect to the jaw members. More specifically, the throat support surfaces are offset to each other and the jaw member driving surfaces immediately adjacent thereto at an interior angle of about 120 degrees, in the case of a wrench of the present invention used with hexagonal nuts or bolt heads, preferably, approximately 123 degrees. Though the throat support surfaces and interior side faces of the jaw members may be flat planar surfaces, they may also be very slightly convex.

The interior side faces of the jaw members and throat support surfaces define an interior for mateably receiving a nut or bolt head. Extending from the top side of each jaw member and the top side of the handle connection portion and overhanging the interior defined by the interior side faces of the jaw members and throat support surfaces is a wrench head overhang, that, when placed over a nut or bolt head, is in contact with the top side of the bolt head or top side (or base) of the nut. The wrench head overhang serves to retain the wrench head over the nut or bolt head so that the wrench head cannot slip down, laterally off of the nut or bolt head. The overhang is dimensioned so that when the wrench of the present invention is used to rotate a nut that has been threaded on a bolt shaft, the bolt shaft will clear the sides of the overhang.

In a first species of the first embodiment, the described wrench head is coupled to the tool handle in a fixed position, the open jaw being offset at an angle relative to the longitudinal axis of the tool handle. In a second species of the first embodiment, the described wrench head is coupled to the tool handle using an indexable, coupling mechanism that allows the open jaw of the wrench head to be indexed to any one of a plurality of positions relative to the longitudinal axis of the tool handle. In a third species of the first embodiment, the described wrench head is coupled to the tool handle using an coupling mechanism that allows the open jaw of the wrench head to be indexed to any one of a plurality of positions relative to the longitudinal axis of the tool handle, and also allows the open jaw of the wrench to be positioned to any one of a plurality of positions relative to the longitudinal axis of the tool handle.

In the second embodiment of the tool of the present invention, the wrench head has a handle connection portion that couples to a tool handle or shaft at a first end and a jaw at the opposite, second end. The handle connection portion can be any desired three dimensional shape such as a cylindrical, cubic or the like and integrally fixed to a tool handle or shaft or having a aperture therein to receive a coupling mechanism component. The jaw extends from the handle connection portion and is then bifurcated into a first jaw member and a second jaw member with an angled throat in the interior portion of the jaw that includes where the first jaw member and second jaw member meet. At the end of each of the first jaw member and the second jaw member opposite of where the respective jaw member connects to the handle connection portion, is a protrusion portion.

Each jaw member has a plurality of faces, the faces being at least a top face and exterior side face, bottom face, interior side face and its respective protrusion portion has a top face, exterior face, bottom face, interior face and end face. If the jaw member is oriented in a three-dimensional grid with x-y-z axes, then the top face and bottom face of the jaw members and their corresponding protrusion portions would be in the plane of the x-z axes and the exterior, interior side faces of the jaw members and their respective protrusions would have components extending into the x-y-z planes. The interior side faces of the first and second jaw members and their respective protrusion portions are the nut or bolt head driving surfaces, the interior side faces of the first and second jaw members being generally parallel, but they may slightly converge outwardly at a small angle of approximately 1-5 degrees to improve the flat engaging contact with the opposite sides of the nut or bolt head.

The throat includes a two flat planar support surfaces angled with respect to each other and angled with respect to the jaw members. More specifically, the throat support surfaces are offset to each other and the jaw member driving surfaces immediately adjacent thereto at an interior angle of about 120 degrees, in the case of a wrench of the present invention used with hexagonal nuts or bolt heads, preferably, approximately 123 degrees. Though the throat support surfaces and interior side faces of the jaw members may be flat planar surfaces, they may also be very slightly convex.

Each of the interior faces of the protrusion portions is a flat planar support surface angled with respect to each other and angled with respect to the interior side faces of the jaw members. More specifically, the interior faces of the protrusion portions are offset to each other and the jaw member driving surfaces immediately adjacent thereto at an interior angle of about 120 degrees, in the case of a wrench of the present invention used with hexagonal nuts or bolt heads, preferably, approximately 123 degrees. Though the interior faces of the protrusion portions may be flat planar surfaces, they may also be very slightly convex.

The interior side faces of the jaw members, throat support surfaces and interior faces of the protrusion portions define an interior for mateably receiving a nut or bolt head. Extending from the top side of each jaw member, and the top side of the handle connection portion and overhanging the interior defined by the interior side faces of the jaw members, protrusion portions, and throat support surfaces is a wrench head overhang, that, when placed over a nut or bolt head, is in contact with the top side of the bolt head or top side of the nut. The wrench head overhang serves to retain the wrench head over the nut or bolt head so that the wrench head cannot slip down off of the nut or bolt head. The overhang is dimensioned so as to that when the wrench of the present invention is used to rotate a nut that has been threaded on a bolt shaft, the bolt shaft will clear the sides of the overhang.

In a first species of the second embodiment, the described wrench head is coupled to the tool handle in a fixed position, the open jaw being offset at an angle relative to the longitudinal axis of the tool handle. In a second species of the second embodiment, the described wrench head is coupled to the tool handle using an indexable, coupling mechanism that allows the open jaw of the wrench head to be indexed to any one of a plurality of positions relative to the longitudinal axis of the tool handle. In a third species of the second embodiment, the described wrench head is coupled to the tool handle using an coupling mechanism that allows the open jaw of the wrench head to be indexed to any one of a plurality of positions relative to the longitudinal axis of the tool handle, and also allows the open jaw of the wrench to be positioned to any one of a plurality of positions relative to the longitudinal axis of the tool handle.

At the distal end of any of the described species, there can be another similar wrench head, or a conventional open-end wrench or a closed-end wrench or a closed ratchet wrench.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The present invention is a variation on the open-end wrench. There are two embodiments of the wrench head of the present invention, each having a number of species related to the coupling mechanism coupling the wrench head to a tool handle or shaft, and the nature of the tool handle or shaft. The tool handle has a distal end and proximate end with the wrench head at the proximate end.

In the first embodiment of the tool of the present invention, the wrench head has a handle connection portion that couples to a tool handle or shaft at a first end and a jaw at the opposite, second end. The handle connection portion can be any desired three dimensional shape such as a cylindrical, cubic or the like and integrally fixed to a tool handle or shaft or having a aperture therein to receive a coupling mechanism component.

Figure 1:
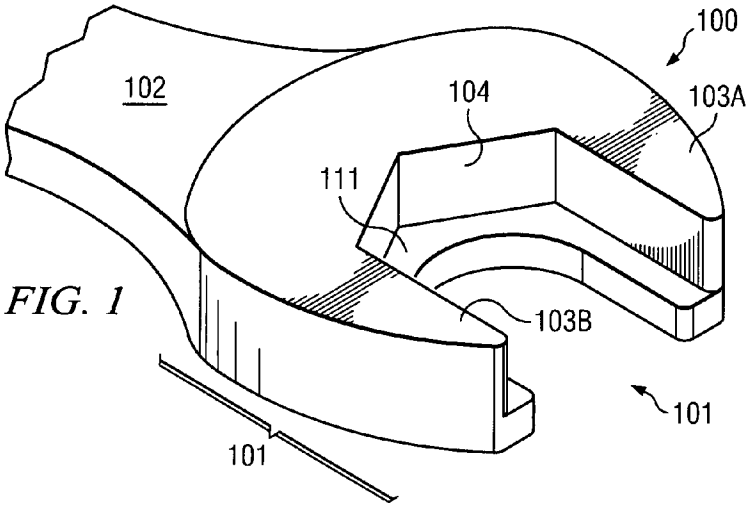
FIG. 1 is a perspective view of the first embodiment of the wrench head of the present invention.

Referring to FIG. 1, the wrench head 100 has a jaw 101 that extends from a handle connection portion 102 and is then bifurcated into a first jaw member 103A and a second jaw member 103B with an angled throat 104 in the interior portion of the jaw 101 that includes where the first jaw member 103A and second jaw member 103B meet.

Figure 2:
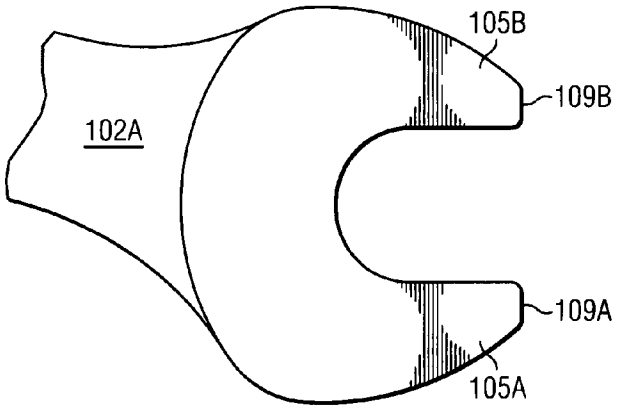
FIG. 2 is a top view of the first embodiment of the wrench head of the present invention.
Figure 3:
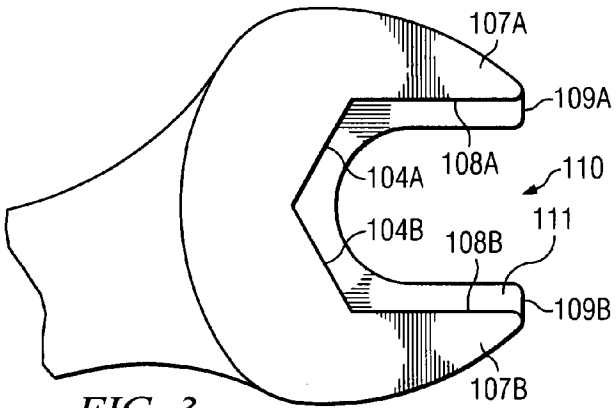
FIG. 3 is a bottom view of the first embodiment of the wrench head of the present invention.
Figure 4:
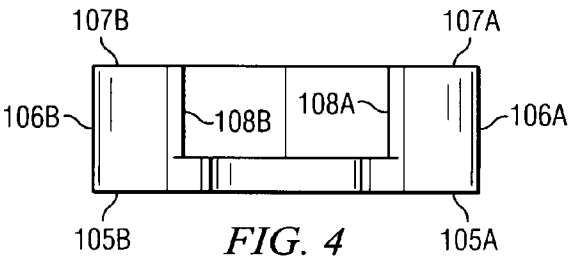
FIG. 4 is a front view of the first embodiment of the wrench head of the present invention.

Referring to FIGS. 2, 3 and 4, each of the jaw members 103A, 103B has a plurality of faces, the faces being at least a top face 105A, 105B, exterior side face 106A, 106B, bottom face 107A, 107B, interior side face 108A, 108B and end face 109A, 109B. If the jaw members 103A, 103B are oriented in a three-dimensional grid with x-y-z axes, then their respective top face 105A, 105B and bottom face 107A, 107B would be in the plane of the x-z axes and the exterior side face 106A, 106B, interior side face 108A, 108B and end faces 109A, 109B would extend primarily into the x-y planes. The interior side faces 108A, 108B of the first and second jaw members 103A, 104B are the nut or bolt head driving surfaces and are generally parallel, but they may slightly converge outwardly at a small angle of approximately 1-5 degrees to improve the flat engaging contact with the opposite sides of the nut or bolt head.

The throat 104 includes two flat planar support surfaces 104A, 104B angled with respect to each other and angled with respect to the jaw members 103A, 103B. More specifically, the throat support surfaces 104A, 104B are offset to each other and the jaw member interior side faces 108A, 108B, which are the driving surfaces, immediately adjacent thereto at an interior angle of about 120 degrees, in the case of a wrench of the present invention used with hexagonal nuts or bolt heads, preferably, approximately 123 degrees. Though the throat support surfaces 104A, 104B and interior side faces 108A, 108B of the jaw members may be flat planar surfaces, they may also be very slightly convex.

Figure 6:
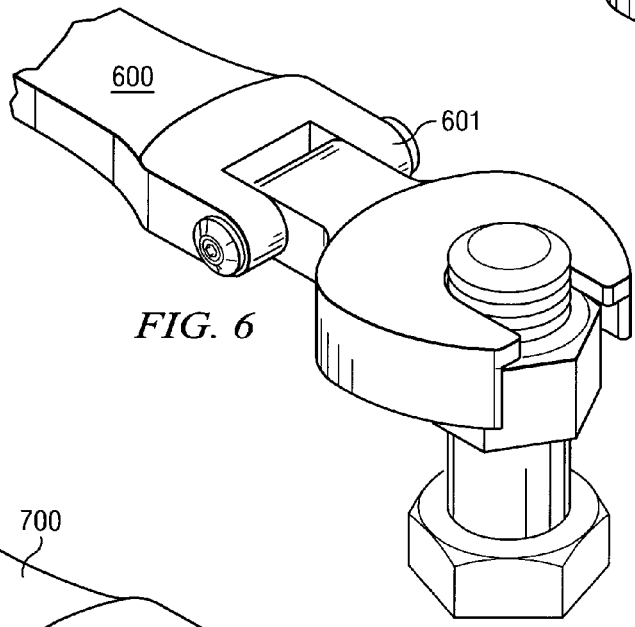
FIG. 6 is a side view of the first embodiment of the wrench head of the present invention coupled to a tool handle with a first indexable coupling means.

The interior side faces 108A, 108B of the jaw members and throat support surfaces 104A, 104B define an interior 110 for mateably receiving a nut or bolt head. Extending from the top side 105A, 105B of each jaw member and the top side 102A of the handle connection portion 102 and overhanging the interior 110 defined by the interior side faces 108A, 108B of the jaw members 103A, 103B and throat support surfaces 104A, 104B is a wrench head overhang 111, that, when placed over a nut or bolt head, is in contact with the top side of the bolt head or top side of the nut. The wrench head overhang 111 serves to retain the wrench head on the top side of the nut or bolt head so that the wrench head 100 cannot slip down off of the nut or bolt head. The wrench head overhang 111 is dimensioned so that when the wrench of the present invention is used to rotate a nut that has been threaded on a bolt shaft, the bolt shaft will clear the sides of the wrench head overhang 111 as seen in FIG. 6.

Figure 5:
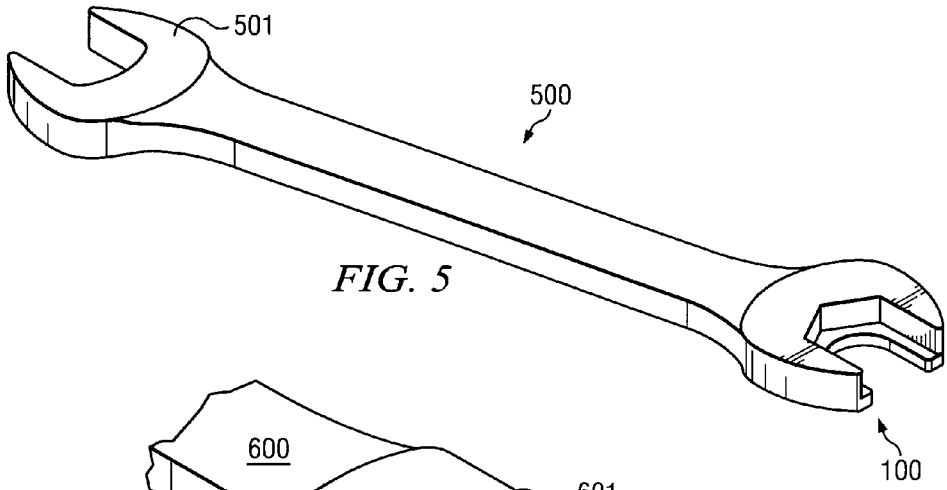
FIG. 5 is a perspective view of the first embodiment of the wrench head of the present invention fixed to a tool handle with an open end wrench at the distal end.
Figure 7:
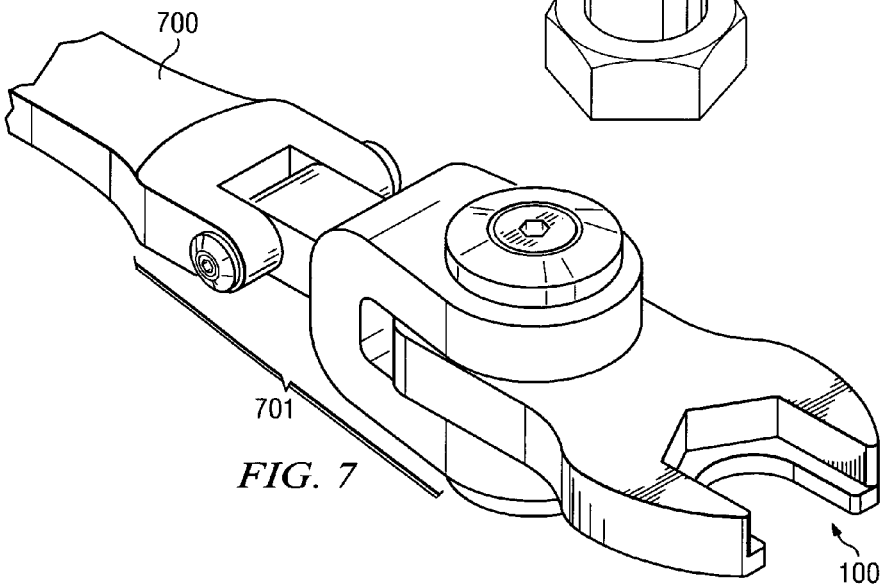
FIG. 7 is a side view of the first embodiment of the wrench head of the present invention coupled to a tool handle with a second indexable coupling means.

As seen in FIG. 5, a first species of the first embodiment includes the above described wrench head 100 coupled to a proximate end of a tool handle 500 in a fixed position, the open jaw being offset at an angle relative to the longitudinal axis of the tool handle 500, with a conventional open end wrench 501 at the distal end of the tool handle 500. As seen in FIG. 6, a second species of the first embodiment of the described wrench head 100 is coupled to a tool handle 600 using an indexable, coupling mechanism 601 that allows the wrench head 100 to be indexed to any one of a plurality of positions relative to the longitudinal axis of the tool handle 600. As seen in FIG. 7, a third species of the first embodiment of the described wrench head 100 is coupled to a tool handle 700 using an coupling mechanism 701 that allows the wrench head 100 to be indexed to any one of a plurality of positions relative to the longitudinal axis of the tool handle 700, and also allows the wrench head 100 to be positioned to any one of a plurality of positions angled relative to a lateral axis of the tool handle 700.

In the second embodiment of the tool of the present invention, the wrench head has a handle connection portion that couples to a tool handle or shaft at a first end and a jaw at the opposite, second end. The handle connection portion can be any desired three dimensional shape such as a cylindrical, cubic or the like and integrally fixed to a tool handle or shaft or having a aperture therein to receive a coupling mechanism component.

Figure 8:
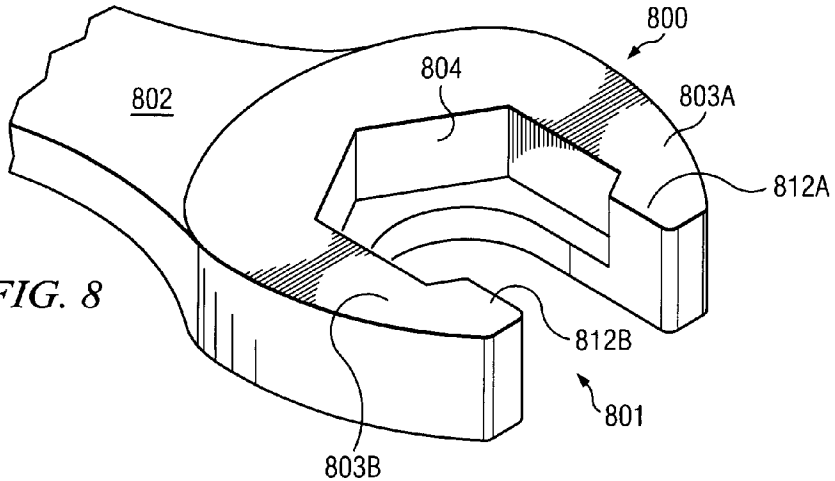
FIG. 8 is a perspective view of the second embodiment of the wrench head of the present invention.

Referring to FIG. 8, the wrench head 800 has a jaw 801 that extends from a handle connection portion 802 and is then bifurcated into a first jaw member 803A and a second jaw member 803B with an angled throat 804 in the interior portion of the jaw 801 that includes where the first jaw member 803A and second jaw member 803B meet. At the end of each of the first jaw member 803A and the second jaw member 803B opposite of where the respective jaw member connects to the handle connection portion, is a protrusion portion 812A, 812B.

Figure 9:
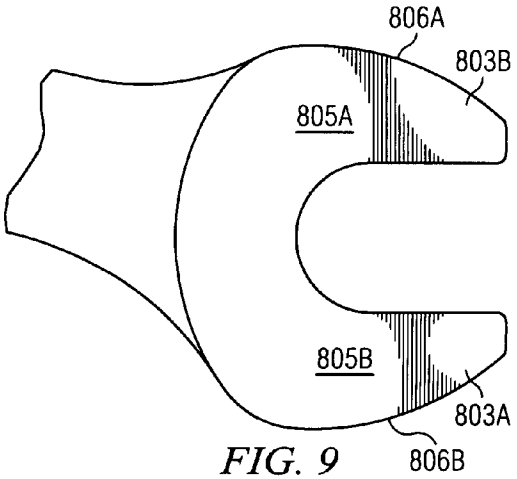
FIG. 9 is a top view of the second embodiment of the wrench head of the present invention.
Figure 10:
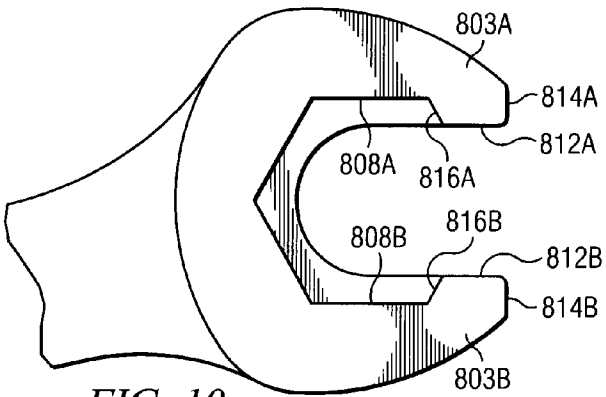
FIG. 10 is a bottom view of the second embodiment of the wrench head of the present invention.
Figure 11:
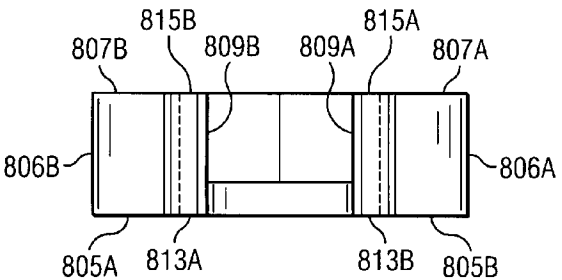
FIG. 11 is a front view of the second embodiment of the wrench head of the present invention.

Referring to FIGS. 9, 10 and 11, each of the jaw members 803A, 803B has a plurality of faces, the faces being at least a top face 805A, 805B, exterior side face 806A, 806B, bottom face 807A, 807B, interior side face 808A, 808B and its respective protrusion portion 812A, 812B has a top face 813A, 813B, exterior face 814A, 814B, bottom face, 815A, 815B, interior face 816A, 816B and end face 809A, 809B.

If the jaw members 803A, 803B are oriented in a three-dimensional grid with x-y-z axes, then their respective top face 805A, 805B and bottom face 807A, 807B and their corresponding protrusion portions 813A, 813B, 815A, 815B would be in the plane of the x-z axes, and the exterior side face 806A, 806B, interior side face 808A, 808B of the jaw members and their respective protrusions portions 814A, 814B, 816A, 816B, 809A, 809B would have components extending primarily into the x-y planes.

The interior side faces 808A, 808B of the first and second jaw members 803A, 803B and their respective interior faces 816A, 816B of the protrusion portions 812A, 812B are the nut or bolt head driving surfaces and are generally parallel, but they may slightly converge outwardly at a small angle of approximately 1-5 degrees to improve the flat engaging contact with the opposite sides of the nut or bolt head.

The throat 804 includes two flat planar support surfaces 804A, 804B angled with respect to each other and angled with respect to the jaw members 803A, 803B. More specifically, the throat support surfaces 804A, 804B are offset to each other and the jaw member interior side faces 808A, 808B, which are the driving surfaces, immediately adjacent thereto at an interior angle of about 120 degrees, in the case of a wrench of the present invention used with hexagonal nuts or bolt heads, preferably, approximately 123 degrees. Though the throat support surfaces 804A, 804B and interior side faces 808A, 808B of the jaw members may be flat planar surfaces, they may also be very slightly convex.

Each of the interior faces 816A, 816B of the protrusion portions 812A, 812B is a flat planar support surface angled with respect to each other and angled with respect to the interior side faces 808A, 808B of the jaw members 803A, 803B. More specifically, the interior faces 816A, 816B of the protrusion portions 812A, 812B are offset to each other and the jaw member 803A, 803B driving surfaces immediately adjacent thereto at an interior angle of about 120 degrees, in the case of a wrench of the present invention used with hexagonal nuts or bolt heads, preferably, approximately 123 degrees. Though the interior faces 816A, 816B of the protrusion portions 812A, 812B may be flat planar surfaces, they may also be very slightly convex.

The interior side faces 808A, 808B of the jaw members 803A, 803B, throat support surfaces 804A, 804B and interior faces 816A, 816B of the protrusion portions 812A, 812B define an interior 810 for mateably receiving a nut or bolt head. Extending from the top side 805A, 805B of each jaw member and the top side 802A of the handle connection portion 802 and overhanging the interior 810 defined by the interior side faces 808A, 808B of the jaw members 803A, 803B, protrusion portions 812A, 812B and throat support surfaces 804A, 804B is a wrench head overhang 811, that, when placed over a nut or bolt head, is in contact with the top side of the bolt head or top side of the nut. The wrench head overhang 811 serves to retain the wrench head on the top side of the nut or bolt head so that the wrench head 800 cannot slip laterally down, off of the nut or bolt head, whereas the protrusion portions 812A, 812B serve to keep the wrench head from disengaging the nut or bolt head longitudinally. The wrench head overhang 811 is dimensioned so when the wrench of the present invention is used to rotate a nut that has been threaded on a bolt shaft, the bolt shaft will clear the sides of the wrench head overhang 811 as seen in FIG. 12.

Figure 12:
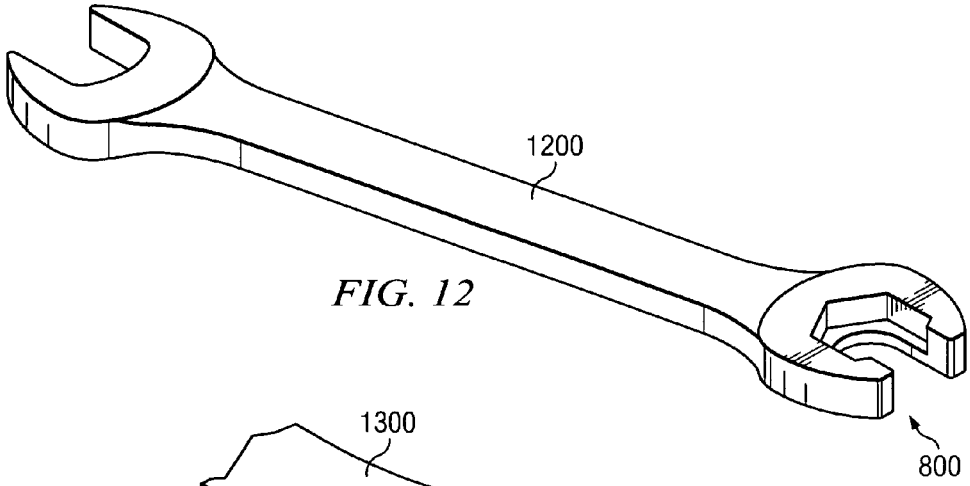
FIG. 12 is a perspective view of the second embodiment of the wrench head of the present invention fixed to a tool handle with an open end wrench at the distal end.
Figure 13:
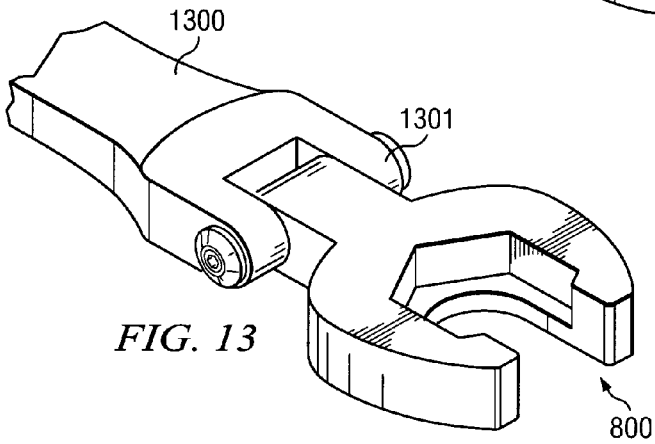
FIG. 13 is a side view of the second embodiment of the wrench head of the present invention coupled to a tool handle with a first indexable coupling means.
Figure 14:
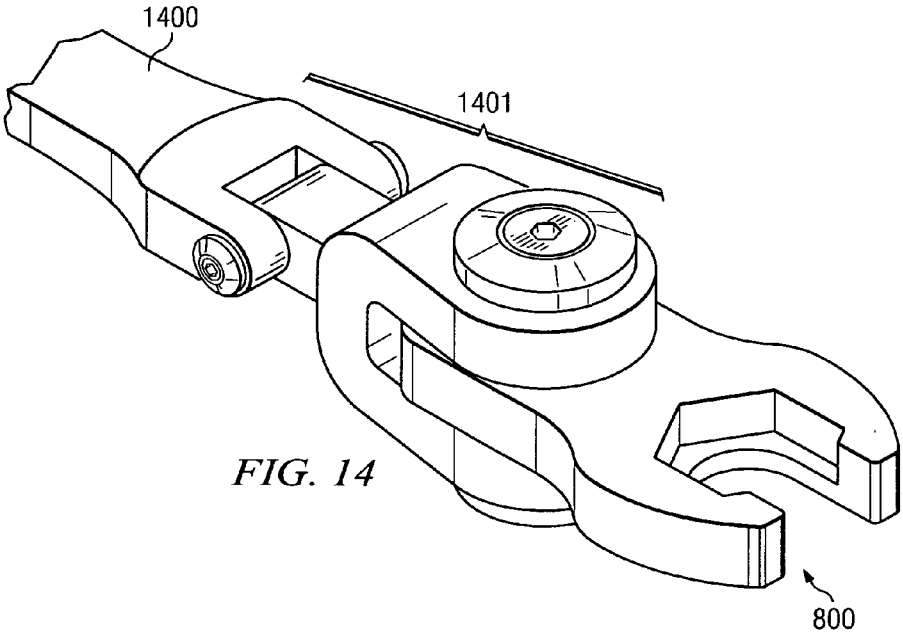
FIG. 14 is a side view of the second embodiment of the wrench head of the present invention coupled to a tool handle with a second indexable coupling means.

As seen in FIG. 12, a first species of the second embodiment includes the above described wrench head 800 coupled to a proximate end of a tool handle 1200 in a fixed position, the open jaw being offset at an angle relative to the longitudinal axis of the tool handle 1200, with a conventional open end wrench at the distal end of the tool handle 1200. As seen in FIG. 13, a second species of the second embodiment of the described wrench head 800 is coupled to a tool handle 1300 using an indexable, coupling mechanism 1301 that allows the wrench head 800 to be indexed to any one of a plurality of positions relative to the longitudinal axis of the tool handle 1300. As seen in FIG. 14, a third species of the first embodiment of the described wrench head 800 is coupled to a tool handle 1400 using an coupling mechanism 1401 that allows the wrench head 800 to be indexed to any one of a plurality of positions relative to the longitudinal axis of the tool handle 1400, and also allows the wrench head 800 to be positioned to any one of a plurality of positions angled relative to a lateral axis of the tool handle 1400.

The coupling mechanisms 601, 1201 include a splined orifice, e.g., in the respective handle connection portion 102, 802 and at least one splined orifice in the tool handle 600, 1300 as seen in FIGS. 6 and 13 respectively. As used herein, splines and splined portions refer to any one of a series of narrow keys (external splines) formed longitudinally around the circumference of a shaft that fits into corresponding grooves (internal splines) in a mating part. As noted, the tool handle 600, 1300 have a proximate and distal end. The proximate end includes at least one orifice for receiving an indexing mechanism coupled to a tool head. The coupling mechanism can be any desired construction that allows the user to unlock, reposition and lock the wrench head relative to the tool handle. One such coupling mechanism uses a partially splined pin that is inserted into the splined orifices of the handle connection portion and splined orifice(s) in the handle, with a spring mechanism that biases the pin in a position that locks the wrench head with respect to the tool handle. When pressed in by a user, the wrench head is unlocked and allowed to be repositioned with respect to the tool handle.

A plurality of indexable joint mechanisms can be used between the wrench head and the proximate end of the tool handle. For example, and not by limitation, the coupling mechanism can include a prong at the proximate end of the tool handle with a round aperture bored through a first face of the prong to the second, opposite face of the prong, with splines being formed along the inner circumference of the aperture from the first face of the prong through the aperture to just inside the second face of the prong, there being a smooth circular, square cut from where the splined portion ends to plane of the second face of the prong, the cut having a diameter greater than the diameter of the splined portion of the aperture. A similar splined aperture can be provided in the handle connection portion. A partially splined pin is then coaxially inserted through the orifices, a flat spring being placed in the square cut and end caps being coupled to the ends of the pin to hold the pin between the prongs. The alignment of the splined portions of the pin with the splined portions of the aperture operate to lock the wrench head in position with respect to the tool handle, whereas the alignment of the splined portions of the either the pin or apertures with machined portions of the other, operated to unlock the wrench head with respect to the tool handle.

As seen in FIGS. 7 and 14, the coupling mechanism can further be embodied in a tool handle having at the proximate end a first prong and a second prong bifurcated from the proximate end. The first prong and second prong each having outer faces a positioned to each other and inner faces facing each other. The first prong has a circular aperture located therethrough with splines being formed along the inner circumference thereof, and the second prong has a circular aperture located therethrough with splines being formed along the inner circumference thereof, the apertures of the first prong and second prong being coaxially aligned and having a diameter and spline spacing substantially the same as that of the aperture in the tool connection portion of the wrench head. The tool connection portion of the wrench head also has a circular aperture located therethrough with splines being formed along the inner circumference thereof.

A pin is splined and dimensioned to be coaxially inserted into and mate with the inner splines of the aperture of the first prong, the aperture of the tool connection portion of the wrench head and the aperture of the second prong, the pin having a general right cylindrical shape with a first circular base, a second circular base and a side comprising the lateral area of the pin. The pin includes around the circumference of its side, beginning at the first base, a beveled cut portions and splined portions. The pin includes, through its center axis, a bore, there being a threaded portion adapted to receive a bolt at each end. End cap are adapted to be coupled to the first base and second base of the pin. A semi-rigid open wire ring is adapted to be positioned between one of the splined and bevel cut portions of the pin to permit the locking and unlocking of the wrench head from the tool handle.

A variety of tool handles can be used in each embodiment and species of the present invention, including tool handles with gripping surfaces. The tool can be made of any number of materials, including hardened steel and aluminum. The wrench heads can be forge cast or machined. The present invention includes combinations with extensions, sometimes called "extender arms", universal joints, flex tool handles and adapters.

While two embodiments and multiple species are shown and described, it will be readily apparent that various changes and modifications could be made therein without departing from the scope of the invention. The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution.

What is claimed is:

1. A hand tool, comprising:

a wrench head having a handle connection portion at a first end and a jaw at a second end, the jaw comprised of two jaw members, said jaw members each having an interior side face, the interior side faces of each jaw member facing the other;

wherein the interior side faces of the first and second jaw members are nut or bolt head driving surfaces having flat planar surfaces;

the jaw further having a throat with throat support surfaces, that, along with the jaw members, define an interior for mateably receiving a nut or bolt head;

wherein the throat support surfaces are flat planar surfaces; and a fixed wrench head overhang extending from a top side of each jaw member and a top side of the handle connection portion and overhanging the interior defined by the interior side faces of the jaw members and throat support surfaces, the overhang running continuously from a first end face of the first jaw member to a second end face of the second jaw member.

2. The hand tool of claim 1, wherein the wrench head overhang is dimensioned so as to that when the wrench head placed over a nut that has been threaded on a bolt shaft, the bolt shaft will clear the sides of the overhang.

3. The hand tool of claim 1, wherein each of the two jaw members has a plurality of faces, the faces being at least a top face, exterior side face, bottom face, interior side face and end face;

further wherein the interior side faces of the first and second jaw members are generally parallel, but they may slightly converge outwardly at a small angle of approximately 1-5 degrees to improve the flat engaging contact with the opposite sides of the nut or bolt head;

further wherein the throat includes two flat planar support surfaces angled with respect to each other and angled with respect to the jaw member interior side face immediately adjacent thereto at an interior angle of about 120 degrees.

4. The hand tool of claim 3, in combination with a tool handle having a proximate and distal end.

5. The hand tool of claim 4, wherein the wrench head is coupled to a proximate end of the tool handle in a fixed position.

6. The hand tool of claim 5, further comprising an open end wrench at the distal end of the tool handle.

7. The hand toot of claim 4, wherein the wrench head is coupled to the tool handle using an coupling mechanism that allows the wrench head to be indexed to any one of a plurality of positions relative to the longitudinal axis of the tool handle and also allows the wrench head to be positioned to any one of a plurality of positions angled relative to a lateral axis of the tool handle.

8. The hand tool of claim 4, wherein the wrench head is coupled to the tool handle with an indexable, coupling mechanism that allows the wrench head to be indexed to any one of a plurality of positions relative to the longitudinal axis of the tool handle.

9. A hand tool, comprising:

a wrench head having a handle connection portion at a first end and a jaw at a second end, the jaw comprised of two jaw members, said jaw members each having an interior side face, the interior side faces of each jaw member facing the other;

wherein the interior side faces of the first and second jaw members are nut or bolt head driving surfaces having flat planar surfaces;

the jaw further having a throat with throat support surfaces, that, along with the jaw members, define an interior for mateably receiving a nut or bolt head;

each jaw member having at the end thereof opposite the handle connection portion, a protrusion extending at an angle from the jaw member and having a protrusion interior face;

wherein the throat support surfaces and the protrusion interior faces are flat planar surfaces; and a fixed wrench head overhang extending from a top side of each jaw member and a top side of the handle connection portion and overhanging the interior defined by the interior side faces of the jaw members and throat support surfaces, the overhang running continuously from a first end face of the first law member to a second end face of the second jaw member.

10. The hand tool of claim 9, wherein the wrench head overhang is dimensioned so as to that when the wrench head placed over a nut that has been threaded on a bolt shaft, the bolt shaft will clear the sides of the overhang.

11. The hand tool of claim 9, wherein each of the jaw members has a plurality of faces, the faces being at least a top face, exterior side face, bottom face, interior side face;

further comprising each of the protrusion portions having a top face, exterior face, bottom face, interior face and end face;

further wherein the interior side faces of the first and second jaw members and their respective interior faces of the protrusion portions are generally parallel, but may slightly converge outwardly at a small angle of approximately 1-5 degrees to improve the flat engaging contact with the opposite sides of the nut or bolt head;

further wherein the throat includes two flat planar support surfaces angled with respect to each other and angled with respect to the jaw members, the throat support surfaces being offset to each other and the jaw member interior side faces, immediately adjacent thereto at an interior angle of about 120 degrees, further wherein each of the interior faces of the protrusion portions being a flat planar support surface angled with respect to each other and angled with respect to the interior side faces of the jaw members, the interior faces of the protrusion portions being offset to each other and the jaw member immediately adjacent thereto at an interior angle of about 120 degrees; and further wherein the interior side faces of the jaw members, the throat support surfaces and interior faces of the protrusion portions define an interior for mateably receiving a nut or bolt head.

12. The hand tool of claim 11, in combination with a tool handle having a proximate and distal end.

13. The hand tool of claim 12, wherein the wrench head is coupled to a proximate end of the tool handle in a fixed position.

14. The hand tool of claim 13, further comprising an open end wrench at the distal end of the tool handle.

15. The hand tool of claim 12, wherein the wrench head is coupled to the tool handle using an coupling mechanism that allows the wrench head to be indexed to any one of a plurality of positions relative to the longitudinal axis of the tool handle and also allows the wrench head to be positioned to any one of a plurality of positions angled relative to a lateral axis of the tool handle.

16. The hand tool of claim 12, wherein the wrench head is coupled to the tool handle with an indexable, coupling mechanism that allows the wrench head to be indexed to any one of a plurality of positions relative to the longitudinal axis of the tool handle.

* * * * *